US005510816A

United States Patent [19]

Hosono et al.

[11] Patent Number: 5,510,816

[45] Date of Patent: Apr. 23, 1996

[54] METHOD AND APPARATUS FOR DRIVING INK JET RECORDING HEAD

[75] Inventors: Satoru Hosono; Tomoaki Abe; Shuji Yonekubo; Tsuyoshi Kitahara; Takahiro Katakura, all of Nagano, Japan

[73] Assignee: Seiko Epson Corporation, Tokyo, Japan

[21] Appl. No.: 972,558

[22] Filed: Nov. 6, 1992

[30] Foreign Application Priority Data

| | | | |
|---|---|---|---|
| Nov. 7, 1991 | [JP] | Japan | 3-291669 |
| Dec. 26, 1991 | [JP] | Japan | 3-345342 |
| Oct. 30, 1992 | [JP] | Japan | 4-316632 |

[51] Int. Cl.[6] ..... B41J 2/045

[52] U.S. Cl. ..... 347/10; 347/70

[58] Field of Search ..... 346/1.1, 140 R; 310/316, 317; 347/9, 10, 11, 68, 70, 72; B41J 2/045

[56] References Cited

U.S. PATENT DOCUMENTS

| | | | |
|---|---|---|---|
| 4,284,996 | 8/1981 | Greve | 346/140 R |
| 4,380,018 | 4/1983 | Andoh et al. | 346/140 R |
| 4,383,264 | 5/1983 | Lewis | 346/140 R |
| 4,418,355 | 11/1983 | DeYoung | 346/140 R |
| 4,442,443 | 4/1984 | Martner | 346/140 R |
| 4,509,059 | 4/1985 | Howkins | 346/1.1 |
| 4,546,362 | 10/1985 | Koto | 346/140 R |
| 4,646,106 | 2/1987 | Howkins | 346/1.1 |
| 4,697,193 | 9/1987 | Howkins | 346/1.1 |
| 4,717,927 | 1/1988 | Sato | 346/140 R |
| 5,170,177 | 12/1992 | Stanley et al. | 346/1.1 |

FOREIGN PATENT DOCUMENTS

| | | |
|---|---|---|
| 0159188 | 10/1985 | European Pat. Off. . |
| 443628 | 8/1991 | European Pat. Off. . |
| 224218 | 5/1990 | Japan . |
| 4-001052 | 1/1992 | Japan . |

OTHER PUBLICATIONS

Chip Zeischrif fuer Mikrocomputer–Technik, No. 9, Sep. 1988, Wurzburg de Hammamotu 'Tintenstrahldrucker: Vorurteil Uberwunden'.

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

A method of driving an ink jet recording head comprising the steps of: retreating a vibrating plate to a predetermined position from a nozzle opening at such a speed as to allow a meniscus at the nozzle opening to be jetted from the nozzle opening while applying a drive voltage to a piezoelectric vibrating element; holding the vibrating plate at the position; and advancing the vibrating plate toward the nozzle opening when the meniscus has returned to a position ⅓ or more of the farthest retreat position thereof. As a result, a pressure chamber contracted to thereby apply pressure to ink when inertial stream of the ink become stable and heads toward the nozzle opening, producing an ink droplet to be jetted at a predetermined speed irrespective of the position of the meniscus.

12 Claims, 18 Drawing Sheets

0μsec

2μsec

4μsec

6μsec

8μsec

10μsec

12μsec

14μsec

16μsec

18μsec

20μsec

22μsec

24μsec

26μsec

28μsec

30μsec

32μsec

34μsec

36μsec

38μsec

40μsec

12μsec

14μsec

16μsec

18μsec

20μsec

22μsec

24μsec

26μsec

28μsec

30μsec

14μsec

16μsec

18μsec

20μsec

22μsec

24μsec

26μsec

28μsec

30μsec

32μsec

16μsec

18μsec

20μsec

22μsec

24μsec

26μsec

28μsec

30μsec

32μsec

34μsec

18 μsec

20 μsec

22 μsec

24 μsec

26 μsec

28 μsec

30 μsec

32 μsec

34 μsec

36 μsec

20μsec

22μsec

24μsec

26μsec

28μsec

30μsec

32μsec

34μsec

36μsec

38μsec

22μsec

24μsec

26μsec

28μsec

30μsec

32μsec

34μsec

36μsec

38μsec

40μsec

24 μsec

26 μsec

28 μsec

30 μsec

32 μsec

34 μsec

36 μsec

38 μsec

40 μsec

42 μsec

HOLDING TIME
(μs)

METHOD AND APPARATUS FOR DRIVING INK JET RECORDING HEAD

BACKGROUND OF THE INVENTION

1. Field of the Invention

The invention relates to the art of driving an ink jet recording head that ejects an ink droplet from a nozzle opening by displacing a resilient plate forming a pressure chamber with a rod-like piezoelectric vibrating element and compressing the pressure chamber by such displacement.

2. Prior Art

As disclosed in Japanese Patent Publication No. Hei 2-24218, ink jet recording heads having disk-shaped piezoelectric vibrating substrates secured to a resilient plate forming pressure chambers has heretofore been used for recording apparatuses. In the ink jet recording heads of this type, displacement of each piezoelectric vibrating element is so small that a large effective area must be provided, which in turn ensures a relatively large area. These ink jet recording heads are of such a structure that the pressure chambers are located distant from the nozzle openings and communicate with the nozzle openings through flow paths. This not only makes the recording heads large in structure, but also entails the complicated operation of adjusting the fluid resistances of the respective ink flow paths so as to be consistent.

To overcome the above problems, proposed in, e.g., the specification of U.S. Pat. No. 4,697,193, is an ink jet recording head that produces ink droplets by arranging rod-like piezoelectric vibrating elements and abutting these elements against the resilient plate that forms the pressure chambers to allow the piezoelectric vibrating elements to vibrate vertically. Since the piezoelectric vibrating elements can be disposed so as to confront the nozzle openings in this type of ink jet recording head, the flow paths for connecting the pressure chambers to the nozzle openings can be dispensed with. In addition, the piezoelectric vibrating elements can be prepared in lamination form, which contributes not only to decreasing the drive voltage, but also to improving the print speed owing to the fact that the eigenfrequency of the piezoelectric vibrating element is comparatively large and that this permits high-speed driving of the head.

The ink jet recording head utilizing vertical vibration is driven by a so-called "pull-and-strike" method, in which a drive voltage is applied to the piezoelectric vibrating elements to contract them before forming dots and the drive voltage is then discharged to expand the piezoelectric vibrating elements so that ink droplets are produced.

Such pull-and-strike method not only allows elastic energy prestored in the piezoelectric vibrating elements and the vibrating plate to be utilized, but also ensures that ink will be introduced to the pressure chambers. On the other hand, if the frequency of repeating the operation of the piezoelectric vibrating elements is increased to improve the print speed, the meniscus varies from one position to another each time an ink droplet is formed, thus varying the size and speed of the ink droplets and making the print quality inconsistent.

To avoid these problems, a driving technique in which the piezoelectric vibrating element contracting speed is set to a smallest possible value so as to minimize the varying distance of the meniscus; the piezoelectric vibrating elements are held as contracted for a predetermined time period until the meniscus returns to the original position and stays stationary; and the piezoelectric vibrating elements are expanded by applying a second drive voltage.

This drive technique contributes to ensuring a stable print quality, but imposes a new problem that the high-speed response of each piezoelectric vibrating element cannot be fully utilized.

SUMMARY OF THE INVENTION

The invention has been made in view of the above circumstances. Accordingly, an object of the invention is to provide a method of driving an ink jet recording head utilizing the vertical vibration mode that allows high-speed drive while maintaining high print quality.

Another object of the invention is to provide an apparatus on which to achieve the above method.

To achieve the above objects, the invention is applied to a method of driving an ink jet recording head in which pressure chambers are formed by disposing a vibrating plate so as to communicate with nozzle openings and in which ends of piezoelectric vibrating elements of a vertical vibration mode are fixed on the vibrating plate. The method involves the steps of: retreating the vibrating plate from the nozzle opening to a predetermined position at such a speed as to allow a meniscus at a nozzle opening to be jetted from the nozzle opening by applying a drive voltage to a piezoelectric vibrating element; holding the vibrating plate at the position; and advancing the vibrating plate to the nozzle opening when the meniscus has returned by ⅓ or more of the retreat distance.

The meniscus retreats from the nozzle opening as the piezoelectric vibrating element contract. The meniscus temporarily stops retreating before and after the piezoelectric vibrating element stops contracting, but at a next instance, the meniscus forms a stream toward the nozzle opening. As the direction of inertial streams of the ink is switched and at the time the meniscus has returned to a position about ⅓ of the original position, the piezoelectric vibrating element expands. As a result, the inertial streams and the pressure produced by the expansion of the piezoelectric vibrating element are applied to the ink adjacent to the nozzle opening, allowing the ink to splash out efficiently from the nozzle opening. When the meniscus returns to a position more than ⅓ of the original position, an ink droplet splashes out at a certain speed independently of the position of the meniscus, ensuring that the printed dots will have stable form and size.

DETAILED DESCRIPTION OF THE PREFERRED EMBODIMENTS

The invention will be described in detail with reference to embodiments shown in the accompanying drawings.

Figure 1:
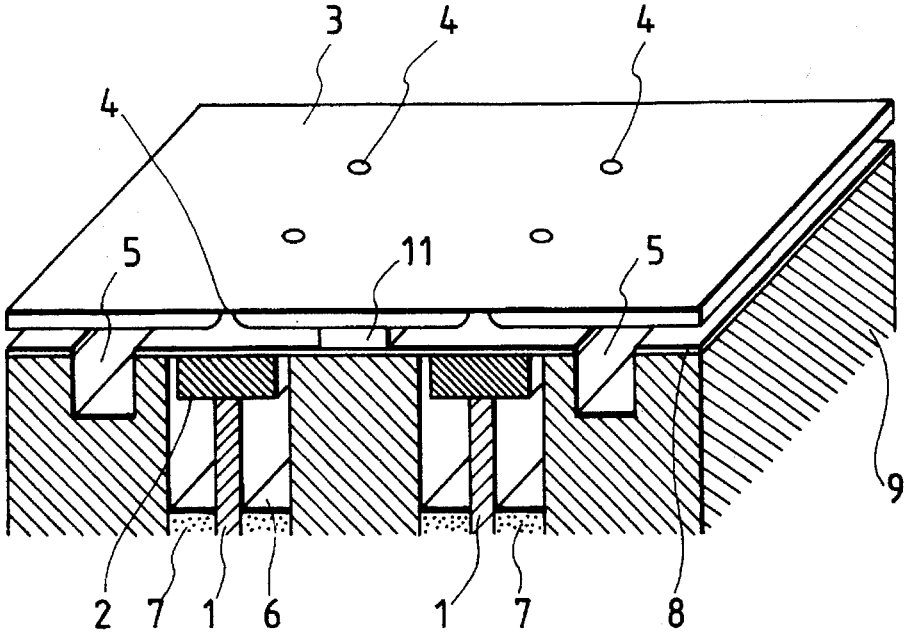
FIG. 1 is a sectional perspective view showing an embodiment of an ink jet recording head to which the invention is applied.
Figure 2:
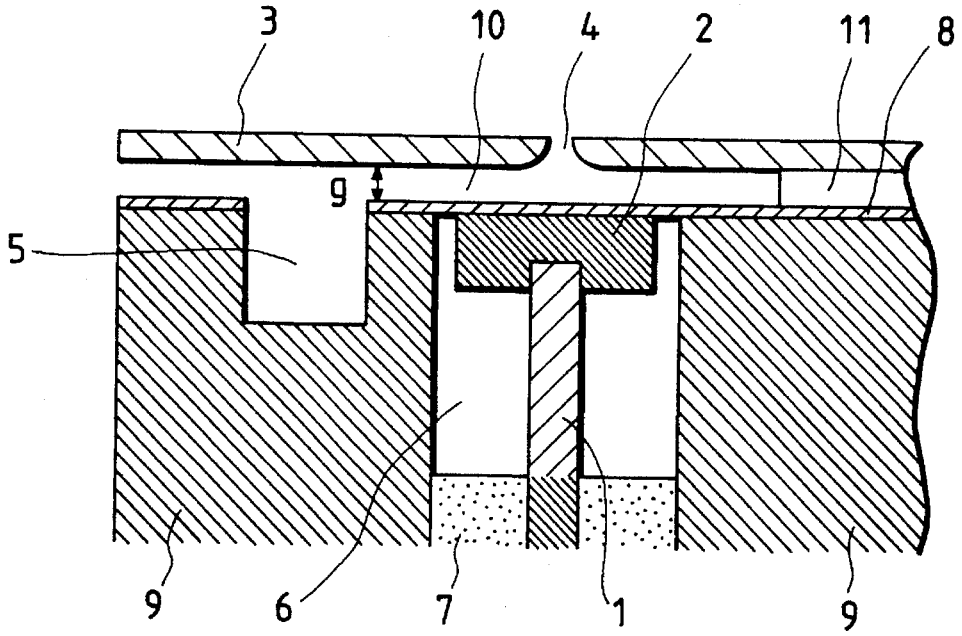
FIG. 2 is a sectional view of the ink jet recording head shown in FIG. 1.

FIGS. 1 and 2 show an embodiment of an ink jet recording head utilizing a vertical vibration mode to which a drive apparatus of the invention will be applied. Reference numeral 1 designates a piezoelectric vibrating element that vibrates in the vertical vibration mode. The piezoelectric vibrating element is formed by sandwiching drive electrodes and a piezoelectric vibrating material while connecting the drive electrodes that interpose the piezoelectric vibrating material in parallel. The advantage of this structure is that all the piezoelectric vibrating layers can be driven by a single voltage; ink droplets can be formed at a drive voltage of about 30 volts.

Figure 3:
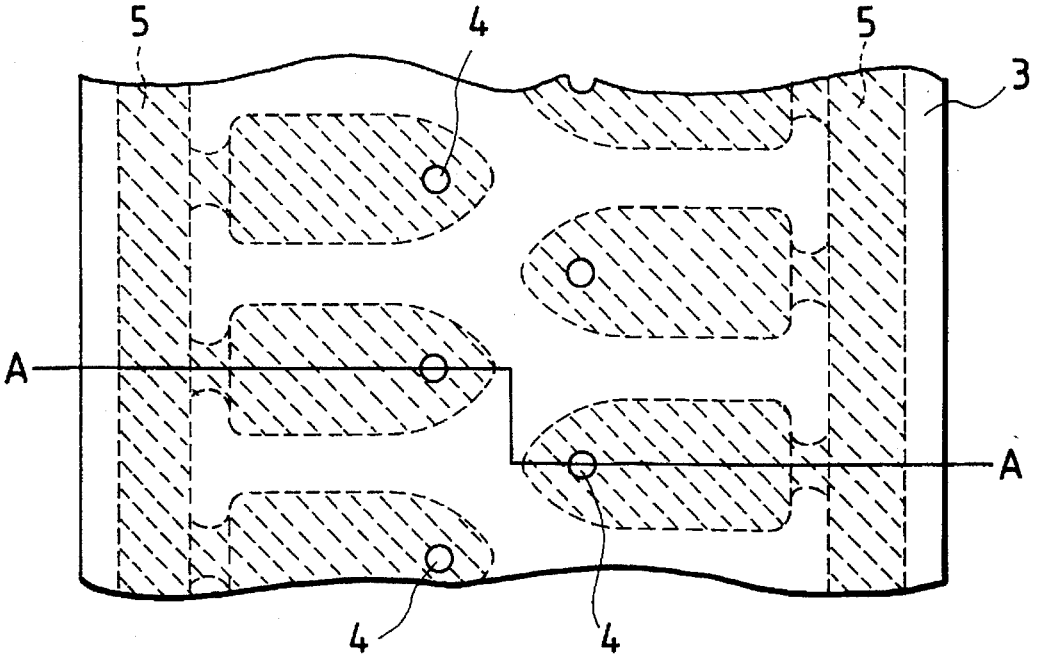
FIG. 3 is a diagram showing an arrangement of ink flow paths and nozzle openings of the ink jet recording head shown in FIG. 1.

One end of the piezoelectric vibrating element 1 is fixed on a base 9 by an insulating adhesive 7 whose elastic coefficient is relatively large, whereas the other end thereof carries a vibrating plate 8 which is made of a highly elastic plate and which forms a pressure chamber 10 through a pressure transmitting member 2. A nozzle plate 3 having nozzle openings 4 is fixed on the base 9 through spacers 11 so as to provide a certain gap with respect to the vibrating plate 8. A space formed between the vibrating plate 8 and the nozzle plate 3 provides the pressure chamber 10, so that ink is supplied from a not shown ink tank through an ink supply path 5 that is a recessed portion arranged in the base 9. The nozzle openings 4 are arranged in a plurality of rows so as to be staggered in an auxiliary scanning direction as shown in FIG. 3. This arrangement permits printing with dots as dense as possible.

Figure 4:
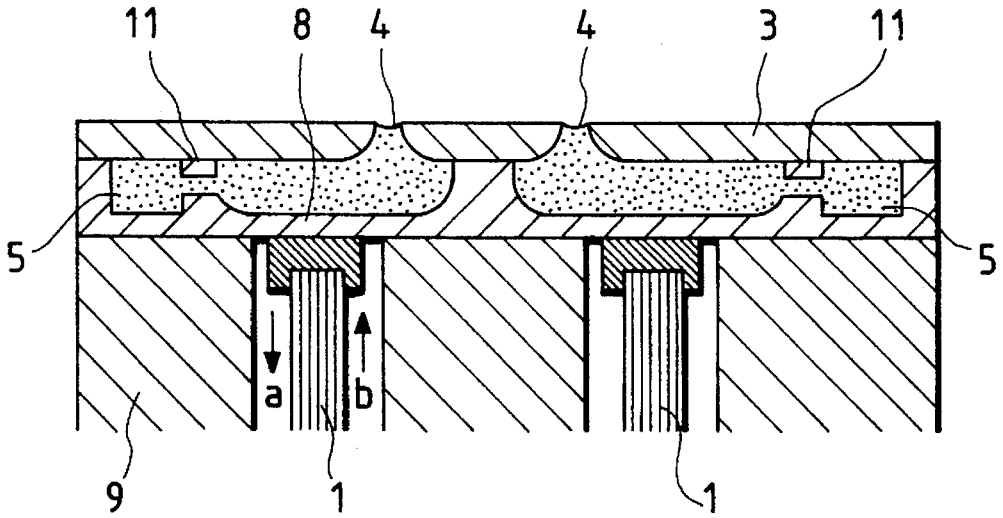
FIG. 4 is a diagram showing motion of piezoelectric vibrating elements in the ink jet recording head shown in FIG. 1.
Figure 5A:
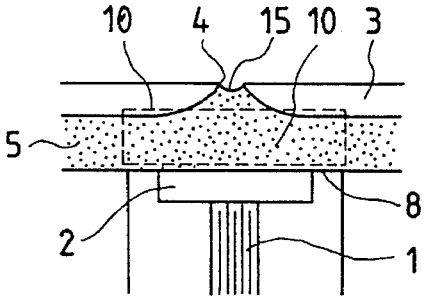
FIGS. 5(A) through 5(D) are diagrams illustrative of the operation of the ink jet recording head shown in FIG. 1.
Figure 5B:
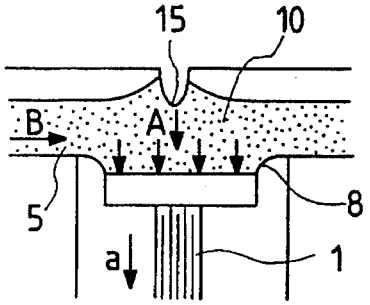

In the thus structured ink jet recording head, a meniscus 15 is positioned almost on the surface of the nozzle opening 4 when no drive voltage is applied to the piezoelectric vibrating element 1 (FIG. 5(A)). When a first drive voltage is applied to the piezoelectric vibrating element 1 so that the element 1 will contract (in a direction indicated by reference character "a" in FIG. 4), the vibrating plate 8 that is fixed on the end of the piezoelectric vibrating element 1 retreats from the nozzle opening 4 while elastically deformed relative to the nozzle plate 3. As a result, the pressure chamber 10 expands and this causes the ink to flow in a direction indicated by reference character "A" in FIG. 5(B). This in turn causes the meniscus 15 to retreat toward the piezoelectric vibrating element 1. At the same time, the ink flows into the pressure chamber 10 from the ink supply flow path 5 while ushered by the stream of ink as indicated by reference character "B" (FIG. 5(B)).

Figure 5C:
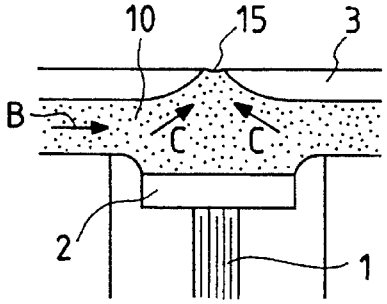
Figure 5D:
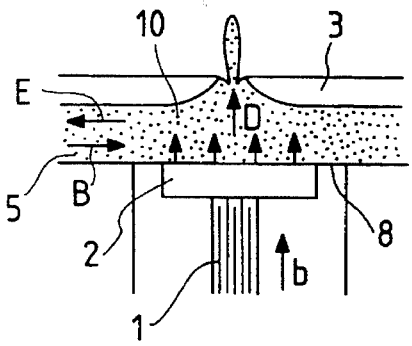

When the piezoelectric vibrating element 1 is maintained as contracted, streams C of the ink toward the nozzle opening are produced in the pressure chamber 10 by inertia (FIG. 5(C), so that the meniscus 15 starts advancing toward the nozzle opening 4. When a drive voltage is applied to the piezoelectric vibrating element 1 so that the element 1 will expand (in a direction indicated by reference character "b" in FIG. 4) while the meniscus is advancing, the vibrating plate 8 is biased against the piezoelectric vibrating element 1 to be elastically deformed toward the nozzle opening to thereby contract the pressure chamber 10. A pressure D thereby produced is added to the inertial streams C (FIG. 5(III)) that has been produced in the previous process to thereby splash out the ink in the pressure chamber 10 as an ink droplet 16 from the nozzle opening 4 (FIG. 5(D)). While the pressure produced by the expansion of the piezoelectric vibrating element 1 produces a stream E toward the ink supply flow path 5 from the pressure chamber 10, such pressure is checked by the inertial stream B produced in the previous process to some degree. This contributes to reducing pressure drop in the pressure chamber 10 to some degree (FIG. 5(D).

Figure 6:
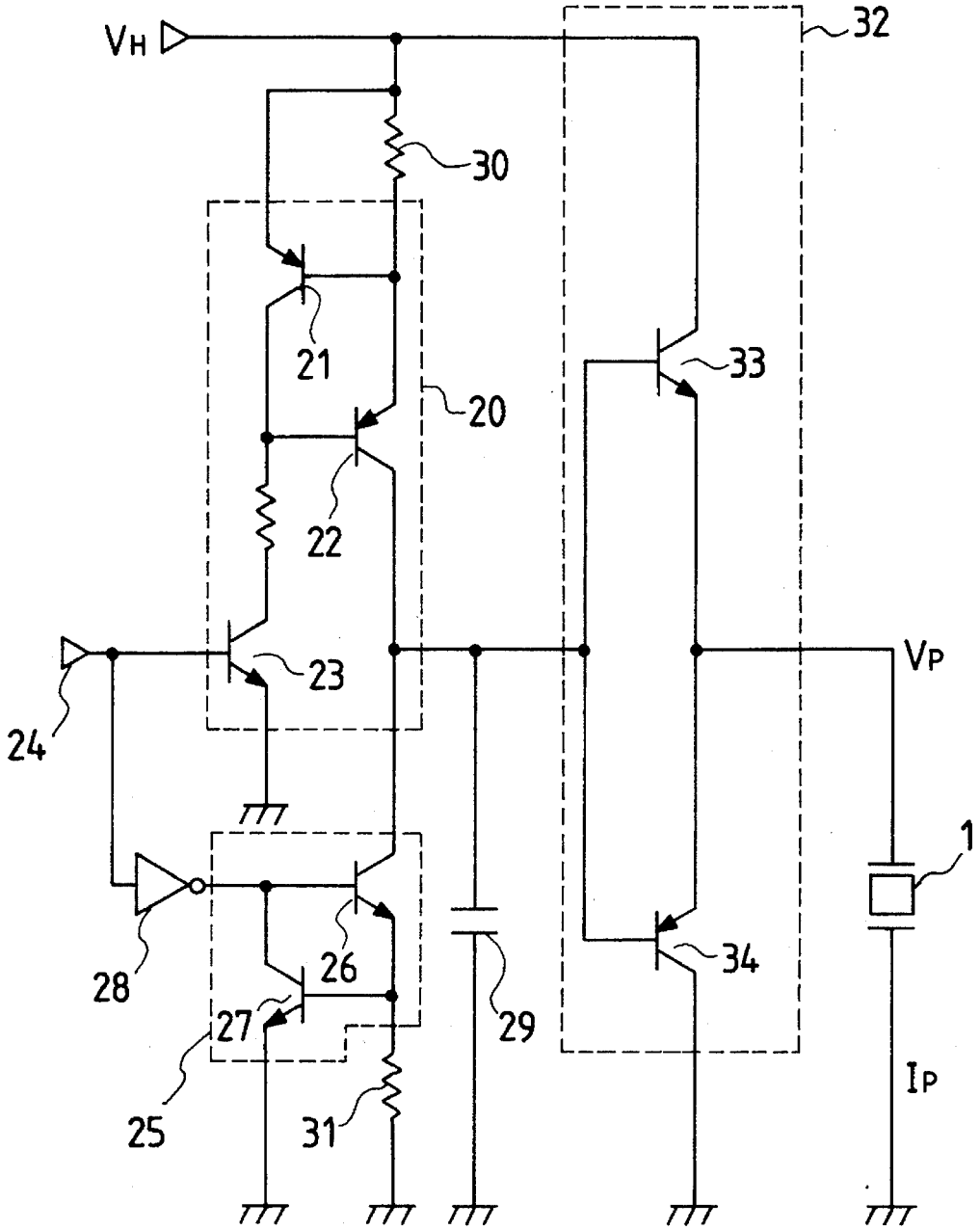
FIG. 6 is a circuit diagram showing an embodiment of a circuit for driving the ink jet recording head shown in FIG. 1.

FIG. 6 shows an embodiment of an apparatus for driving the above-mentioned ink jet recording head. A first switching circuit 20 includes three transistors 21, 22, 23 and turns on when a H-level voltage is applied to an input terminal 24. A second switching circuit 25 includes transistors 26, 27 and is connected to the input terminal 24 through an inverter 28 so that the circuit 25 turns on when a L-level voltage is applied to the input terminal 24. A capacitor 29 forms a time constant circuit. This capacitor 29 is charged by a power supply voltage VH through a resistor 30 when the first switching circuit 20 turns on and discharges through a resistor 31 when the second switching circuit 25 turns on. A current buffer 32 includes transistors 33, 34 and supplies a voltage proportional to the terminal voltage of the capacitor 29 to the piezoelectric vibrating element 1.

Figure 7A:
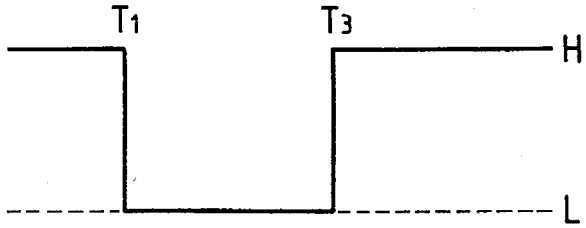
FIGS. 7(A) through 7(D) are diagrams illustrative of a drive signal applied to the drive circuit, a voltage at the terminal of a piezoelectric vibrating element, a charging current, and motion of a meniscus.
Figure 7B:
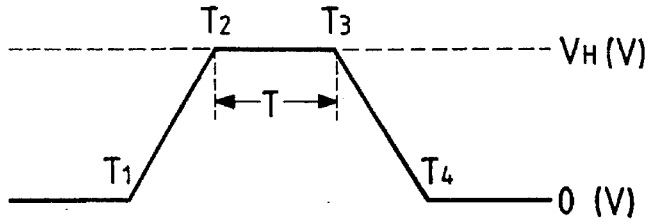
Figure 7C:
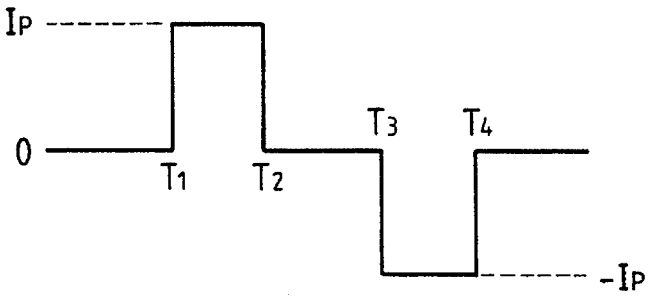
Figure 7D:
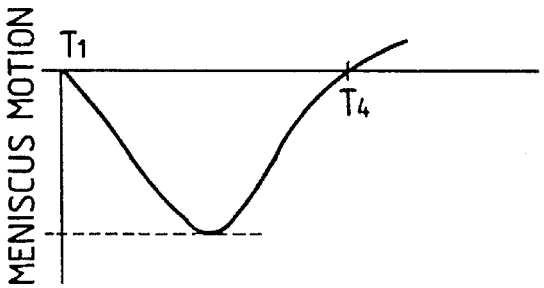
Figure 8:
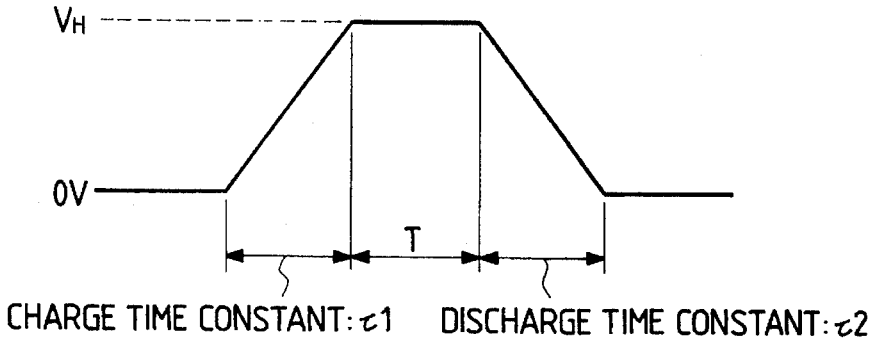
FIG. 8 is a diagram showing a relationship among the contraction, the holding, and the expansion process of the piezoelectric vibrating element.

In the thus configured circuit, when an input signal such as shown in FIG. 7(A) is applied to the input terminal 24 and when the signal goes low, the transistor 22 turns off, which in turn causes a drive voltage VP to rise to the voltage VH. Since the transistor 22 and the capacitor 29, as well as the current buffer 32 connected thereto form a Miller integrator, the waveform of the drive voltage VP applied to the piezoelectric vibrating element 1 depicts a rising straight line with a certain gradient as shown in FIG. 7(B). When the drive voltage VP equals the power supply voltage VH, the voltage stops rising and the drive voltage VP is held at the power supply voltage VH level for a predetermined time thereafter.

When the input signal goes high, the capacitor 29 discharges through the resistor 31, so that the drive voltage VP of the piezoelectric vibrating element 1 depicts a falling line that is substantially symmetrical with respect to the rising portion of the waveform thereof.

By the way, a rising time $\tau 1$ of the drive voltage $V_P$ and a falling time $\tau 2$ thereof are determined by the capacitor 29 and the resistors 30, 31, which constitute a circuit. Assuming that the capacitance of the capacitor 29 is C, the resistance of the resistor 30 is R1, the resistance of the resistor 32 is R2, the base-emitter voltages of the transistors 20, 26 are Vbe1, Vbe2, then $\tau 1$ and $\tau 2$ are expressed as $$\tau 1 = C \times R1 \times VH/VBE1$$

$$\tau 2 = C \times R2 \times VH/VBE2$$

As a result, a current IP flowing through the piezoelectric vibrating element 1 is expressed as $$\begin{aligned} IP &= Cp \times VH/\tau 1 \\ &= Cp \times VBE1/(C \times R1) \\ IP &= Cp \times VH/\tau 2 \\ &= Cp \times VBE2/(C \times R2) \end{aligned}$$

Figure 24:
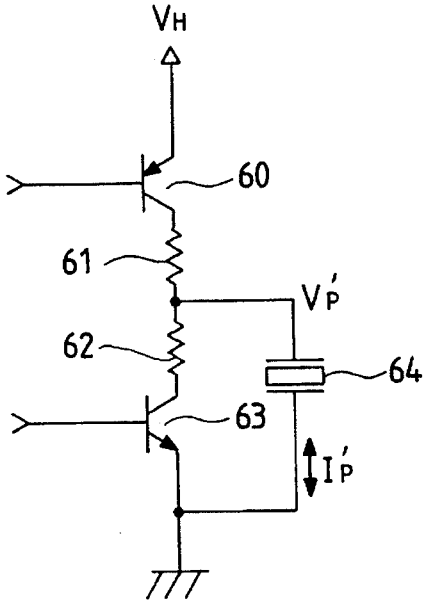
FIG. 24 PRIOR ART
FIG. 24 is a circuit diagram showing an embodiment of a circuit for driving a conventional ink jet recording head.

As is apparent from the current IP, this is a constant current circuit designed to cause a certain current to flow through the piezoelectric vibrating element 1. In contrast thereto, there is a conventional constant voltage circuit that is often used as a circuit for driving a piezoelectric element such as shown in FIG. 24. To drive a piezoelectric element with this constant voltage circuit, a current IP' flowing through the piezoelectric element and a voltage VP' applied to the piezoelectric element vary with time. That is, assuming that the resistance of a resistor 102 is R1' and the resistance of a resistor 103 is R2', the current IP' and the voltage VP' are expressed as $$IP'=(t)=VH/R1' \times \exp\{-t/(Cp \times R1')\}$$

$$VP'=(t)=VH \times [1-\exp\{-t/(Cp \times R1')\}]$$

The time required for the drive voltage VP' to reach the power supply voltage VH is very long in this circuit. However, a time period t0, which is an interval in which the drive voltage reaches a voltage VP'(t) that is 0.9 times the power supply voltage VH can be expressed as $$t0 = 2.3 \times Cp \times R1'$$

assuming that the voltage that can ensure the deformation of the piezoelectric element is the voltage VP'(t) that is 0.9 times the power supply voltage. If R1' is set so that the voltage VP'(t) rises within the time period t0 that is equal to the rising time $\tau 1$, the maximum of IP', that is IP'(0) is expressed as $$\begin{aligned} IP'(0) &= VH/R1' \\ &= VH \times 2.3 \times Cp/\tau 1 = 2.3 \times IP \end{aligned}$$

This indicates that the constant voltage circuit requires the maximum current 2.3 times that of the constant current circuit in order to rise the voltage within the same time period. The above also applies to the falling time.

As described above, the use of the constant current circuit proposed in this embodiment allows the maximum current flowing through the circuit to be reduced even if the charging time and the discharging time are shortened compared with the conventional drive circuit. As a result, the drive circuit can be fabricated with small components and economically.

FIGS. 7(A) through 7(D) are diagrams showing the operation of the above-mentioned drive circuit in waveform. Upon input of a signal such as shown in FIG. 7(A) from a host machine, the first switching circuit 20 turns on as the signal goes low at time T1 to charge the capacitor 29 through the resistor 30. This charging current varies with a time constant $\tau 1$, and a voltage that increases at a certain rate is applied to the piezoelectric vibrating element 1 by the Miller integrating function. Accordingly, the piezoelectric vibrating element 1 contracts at a constant speed, not only causing the vibrating plate 8 to retreat at a constant speed to thereby expand the pressure chamber 10, but also causing the meniscus to retreat as time elapses (FIG. 7(D)).

When the terminal voltage VP of the piezoelectric vibrating element 1 has reached the power supply voltage VH at time T2, the voltage stops rising, causing the expansion of the pressure chamber 10 to stop as well. With the pressure chamber 10 maintained as expanded for a predetermined time (holding time T) and when the meniscus returns to a predetermined position that will be described later, the input signal goes high at time T3. As a result, the second switching circuit 25 turns on to cause the capacitor 29 to discharge through the resistor 31 with a time constant $\tau 2$. Accordingly, the terminal voltage VP of the piezoelectric vibrating element 1 decreases at a certain rate, causing the piezoelectric vibrating element 1 to expand at a constant speed which in turn causes the pressure chamber 10 to contract at a certain rate.

Figure 9:
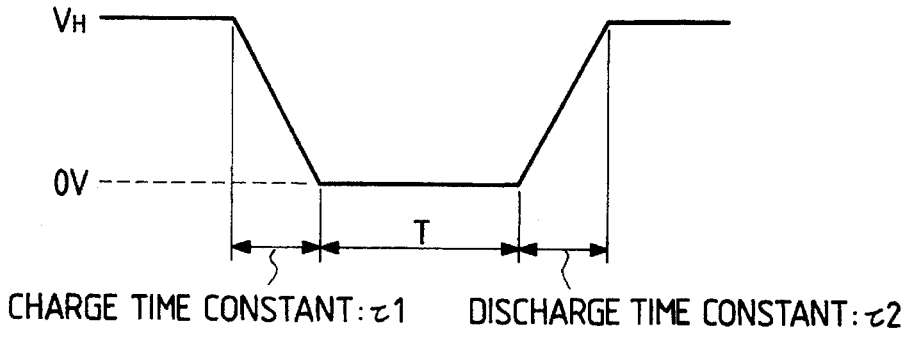
FIG. 9 is a diagram illustrative of the contraction, the holding, and the expansion process of a piezoelectric vibrating element that contracts by discharging.

The example in which the piezoelectric vibrating element contracts by charging and expands by discharging has been described in this embodiment. It goes without saying that if a piezoelectric vibrating element that contracts by discharging and expands by charging is used, the similar operation can be achieved by generating a drive voltage whose rising time constant is $\tau 1$, whose holding time is T, and whose falling time constant is $\tau 2$ with the 0-volt level as a symmetrical line while using a drive signal that first goes high and then goes low as shown in FIG. 9.

Figure 10:
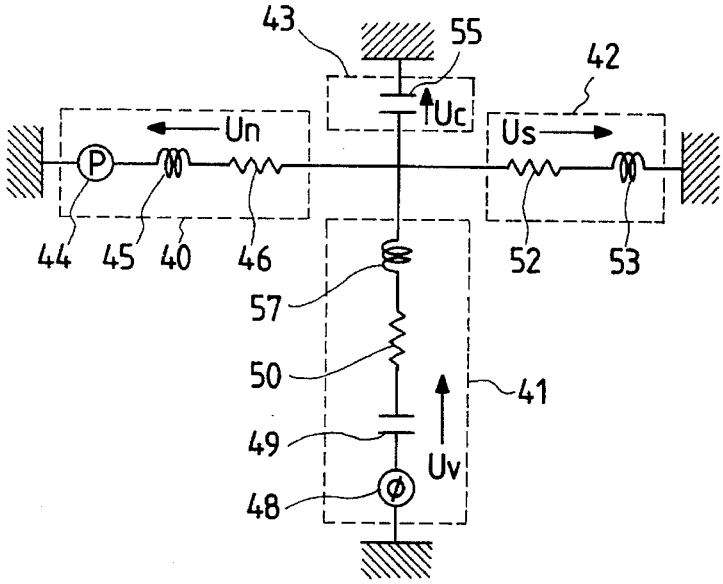
FIG. 10 is a diagram showing an example of a model used to simulate the behavior of ink within a pressure chamber by a drive method of the invention.

By the way, the behavior of the ink in the drive method of the invention will be described in detail by simulation. That is, the drive method involves the steps of: first contracting the piezoelectric vibrating element 1 by applying the first drive voltage to the ink jet recording head to thereby retreat the meniscus formed on the nozzle opening from the surface of the nozzle opening; and then expanding the piezoelectric vibrating element 1 at a proper timing when the meniscus starts advancing. The result of a simulation in which a recording head whose nozzle opening diameter is 40 μm and whose gap g between the nozzle plate 3 and the vibrating plate 8 in the stop condition is 80 μm is operated using an ink whose viscosity is 10 m Pas using an acoustic model shown in FIG. 10 will be presented. This model is an acoustic concentrated constant circuit that models respective sections of the ink jet head as concentrated constants. A concentrated constant circuit 40 for the nozzle section connects a pressure 44 of the meniscus 15 and an acoustic inertance 45 and a resistance 46 of a nozzle in series. A concentrated constant circuit 41 includes the piezoelectric vibrating element 1 and the vibrating plate 8 as single vibrating components, respectively, and connects a pressure producing source 48, a compliance 49, a resistance 50, and an acoustic inertance 57 in series. A concentrated constant circuit 42 representing the pressure chamber 10 connects a resistance 52 and an acoustic inertance 53 in series. A concentrated constant circuit 43 representing deformation of the entire part of the pressure chamber 10 is expressed by a compliance 55. A concentrated constant circuit for the entire part of the ink jet head connects the concentrated constant circuits 40, 41, 42, and 43 in parallel. By the way, the acoustic inertance 45 and the resistance 46 at the time the meniscus 15 fills up the nozzle opening 4 are greater than those at the time the meniscus 15 is in retreat. For this reason, in this simulation, the pressure, the acoustic inertance 45, and the resistance 46 constituting the concentrated constant circuit 40 for the nozzle section are treated as a nonlinear element that changes in accordance with the amount of retreat of the meniscus 15. In this simulation, the pressure plate 8 removes the ink at a volume velocity Uv when the pressure producing source 48 is driven. As a result, volume velocities Un, Uc, Us of the ink at the respective sections varying in a nonsteady-state manner can be obtained. FIGS. 11 through 18 show a simulation of splashing ink droplets while giving the calculated volume velocity Un of the nozzle section as a boundary condition for a general-purpose differential calculus that is capable of handling the behavior of a free surface.

The eigenfrequency of the vibrating system including the acoustic inertances 45, 53 and the compliance 55 is termed as a resonance frequency of the pressure chamber.

Figures 11A, 11B, 11C, 11D, 11E, 11F, 11G, 11H, 11I, 11J, 11K, 11L, 11M, 11N, 11O, 11P, 11Q, 11R, 11S, 11T, 11U:
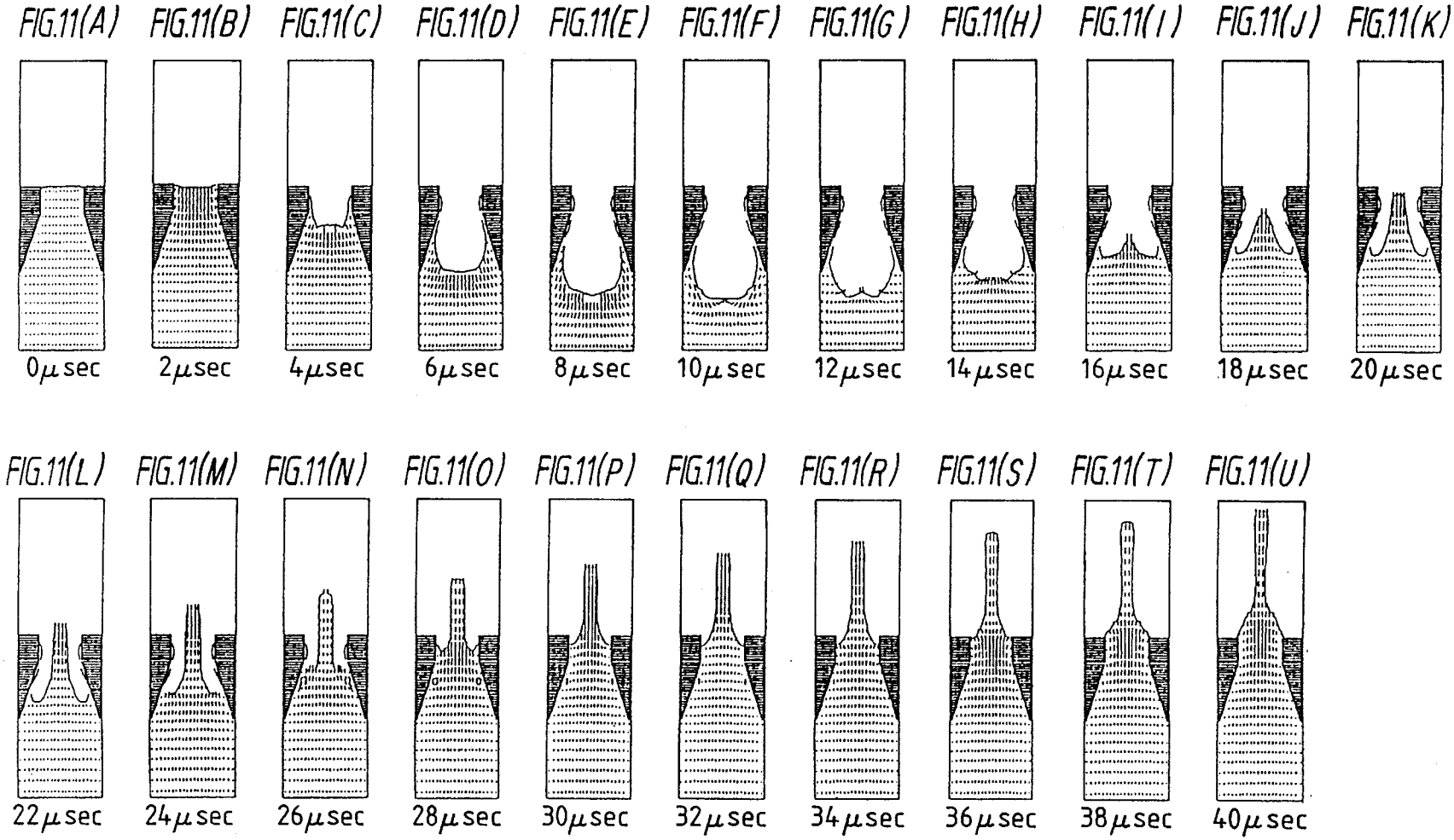
FIGS. 11(A) through 11(u) are diagrams chronologically showing the behavior of the meniscus when the piezoelectric vibrating element is contracted and left as contracted.

FIGS. 11(A) through 11(u) shows a free behavior of the meniscus adjacent to the nozzle opening when the first drive voltage changing at a certain gradient is applied to the piezoelectric vibrating element for 10 μsec and held thereafter. The meniscus continues to retreat from the time at which the drive voltage has been applied (FIG. 11(A)) to the time that is 10 μsec thereafter (FIG. 11(D)). Then, the meniscus is directed toward the nozzle opening. Upon elapse of 22 μsec from the application of the drive voltage (FIG. 11(L), the ink droplet projects from the nozzle opening 4, so that the ink droplet can be developed into such a liquid column as to define a final form thereof (FIG. 11(u).

FIGS. 12 through 18 respectively show, in a sum, the flow of the ink adjacent to the nozzle opening in the case where the meniscus in various positions contract the pressure chamber by the application of the second drive voltage. The selected time constants for the process of both contracting and expanding the piezoelectric vibrating element 1 are 10 μsec, respectively. The various positions of the meniscus are achieved by changing the time between the end of contraction and the start of expansion of the piezoelectric vibrating element, i.e., the above-mentioned holding time.

Figures 12A, 12B, 12C, 12D, 12E, 12F, 12G, 12H, 12I, 12J:
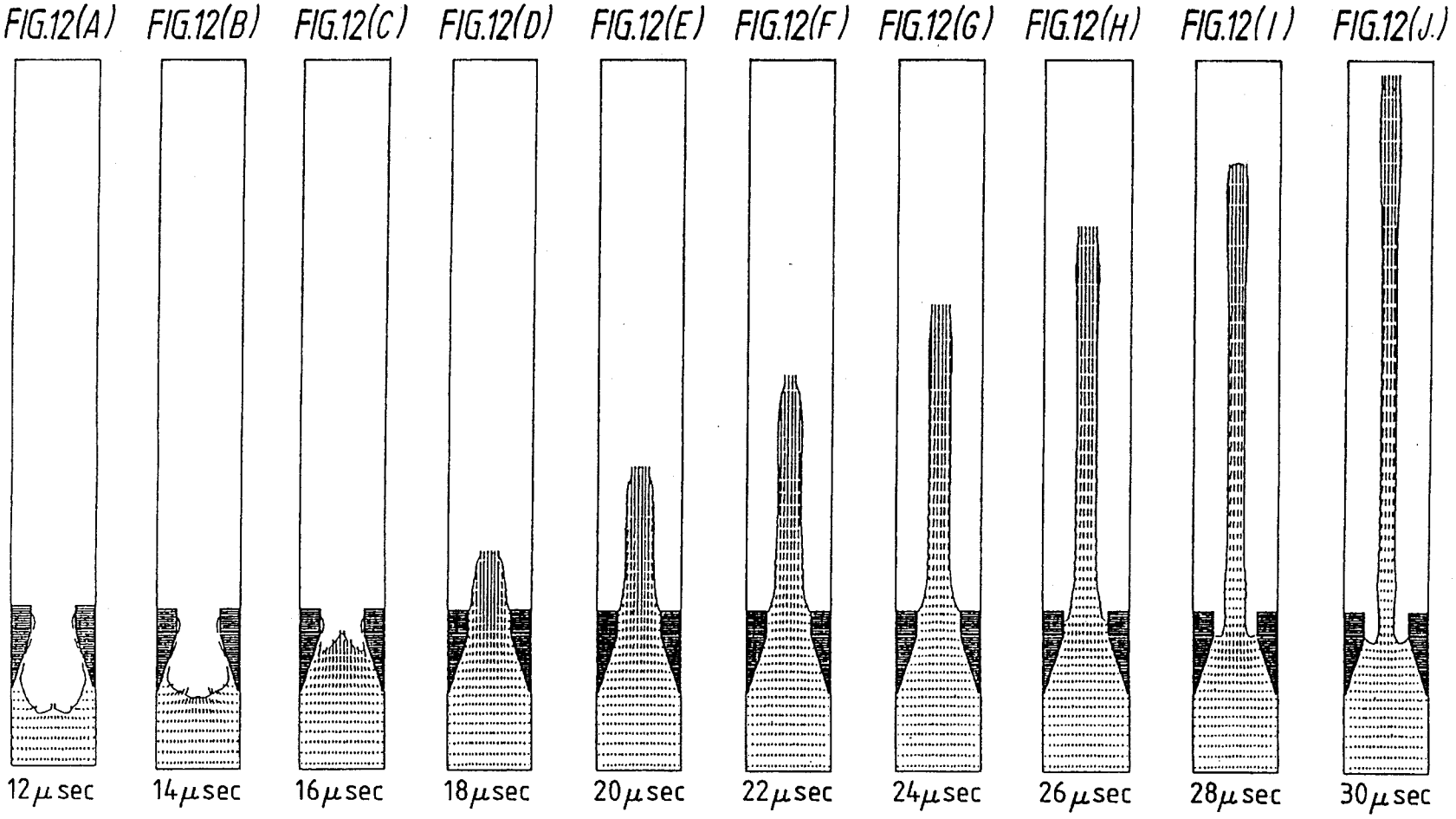
FIGS. 12(A) through 12(J) are diagrams chronologically showing the behavior of the meniscus when the piezoelectric vibrating element is contracted and left as contracted for 2 μsec and then expanded.

FIG. 12 shows flow of the ink when the pressure chamber is contracted upon elapse of 12 μsec from the application of the first drive voltage, i.e., with the holding time being 2 μsec. The pressure chamber is compressed as the meniscus stops retreating and starts an initial phase of advance thereafter while helped by the inertial stream. As a result, the ink splashes out in columnar form, i.e., with the diameter at the end being substantially the same as that at the middle.

Figures 13A, 13B, 13C, 13D, 13E, 13F, 13G, 13H, 13I, 13J:
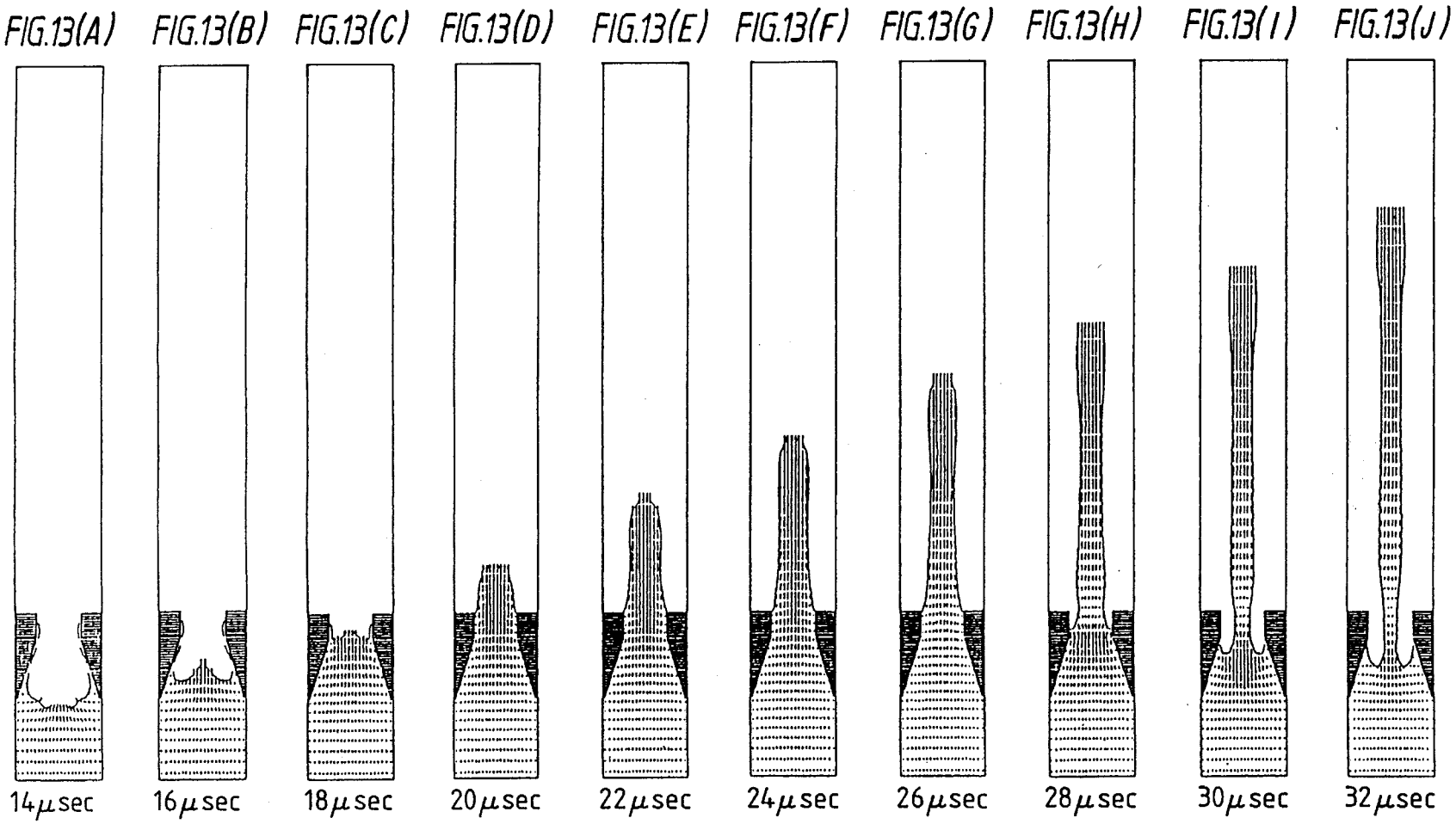
FIGS. 13(A) through 13(J) are diagrams chronologically showing the behavior of the meniscus when the piezoelectric vibrating element is contracted and left as contracted for 4 μsec and then expanded.

FIG. 13 shows flow of the ink when the pressure chamber is contracted upon elapse of 14 μsec from the application of the first drive voltage, i.e., with the holding time being 4 μsec. This is a flow of the ink when the vibrating plate is pushed out into the nozzle opening side as the meniscus makes a small advance toward the nozzle opening after the retreat phase thereof. The ink jetted out of the nozzle opening similarly becomes columnar.

Figures 14A, 14B, 14C, 14D, 14E, 14F, 14G, 14H, 14I, 14J:
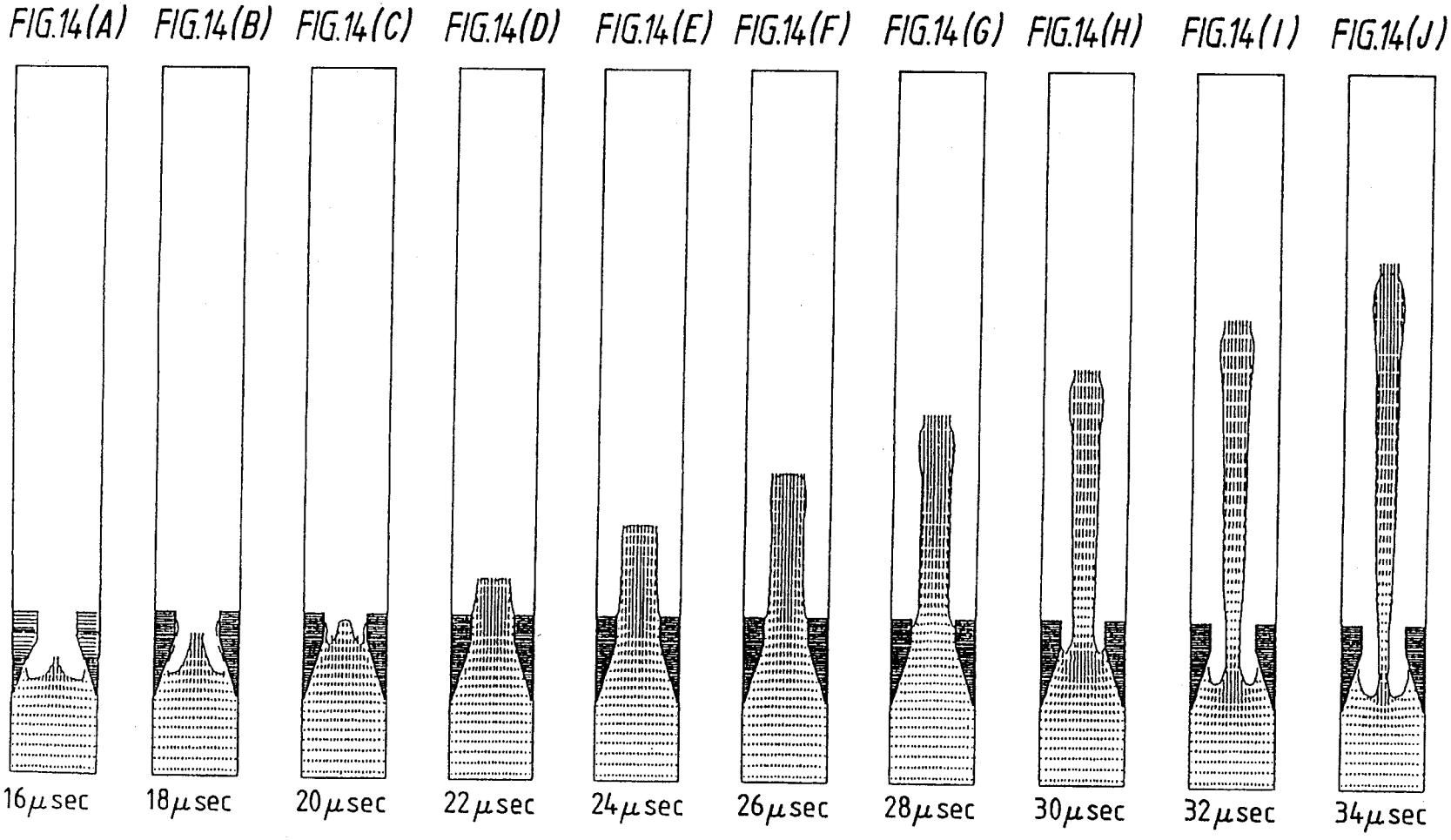
FIGS. 14(A) through 14(J) are diagram chronologically showing the behavior of the meniscus when the piezoelectric vibrating element is contracted and left as contracted for 6 μsec and then expanded.
Figures 15A, 15B, 15C, 15D, 15E, 15F, 15G, 15H, 15I, 15J:
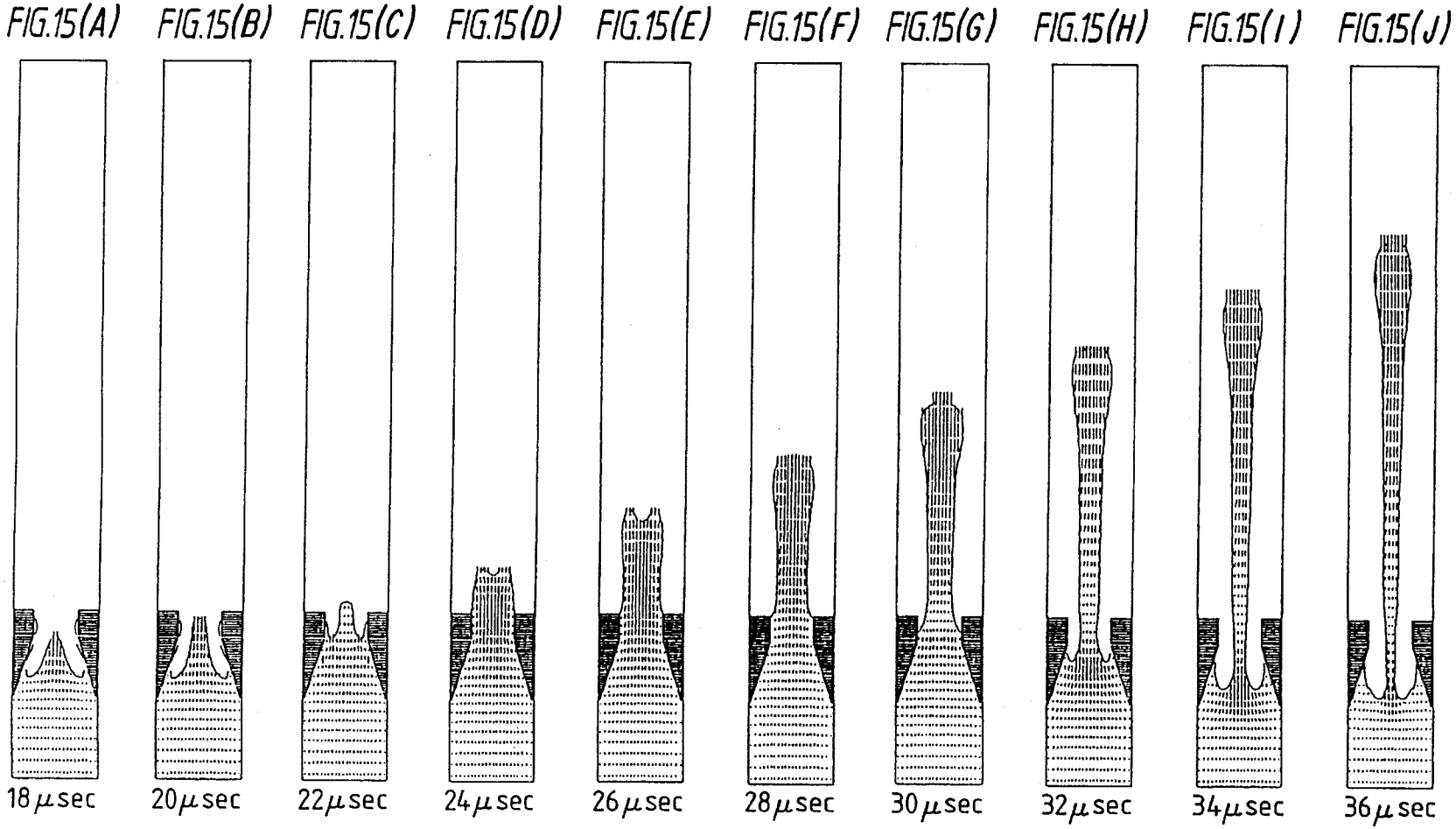
FIGS. 15(A) through 15(J) are diagrams chronologically showing the behavior of the meniscus when the piezoelectric vibrating element is contracted and left as contracted for 8 μsec and then expanded.
Figures 16A, 16B, 16C, 16D, 16E, 16F, 16G, 16H, 16I, 16J:
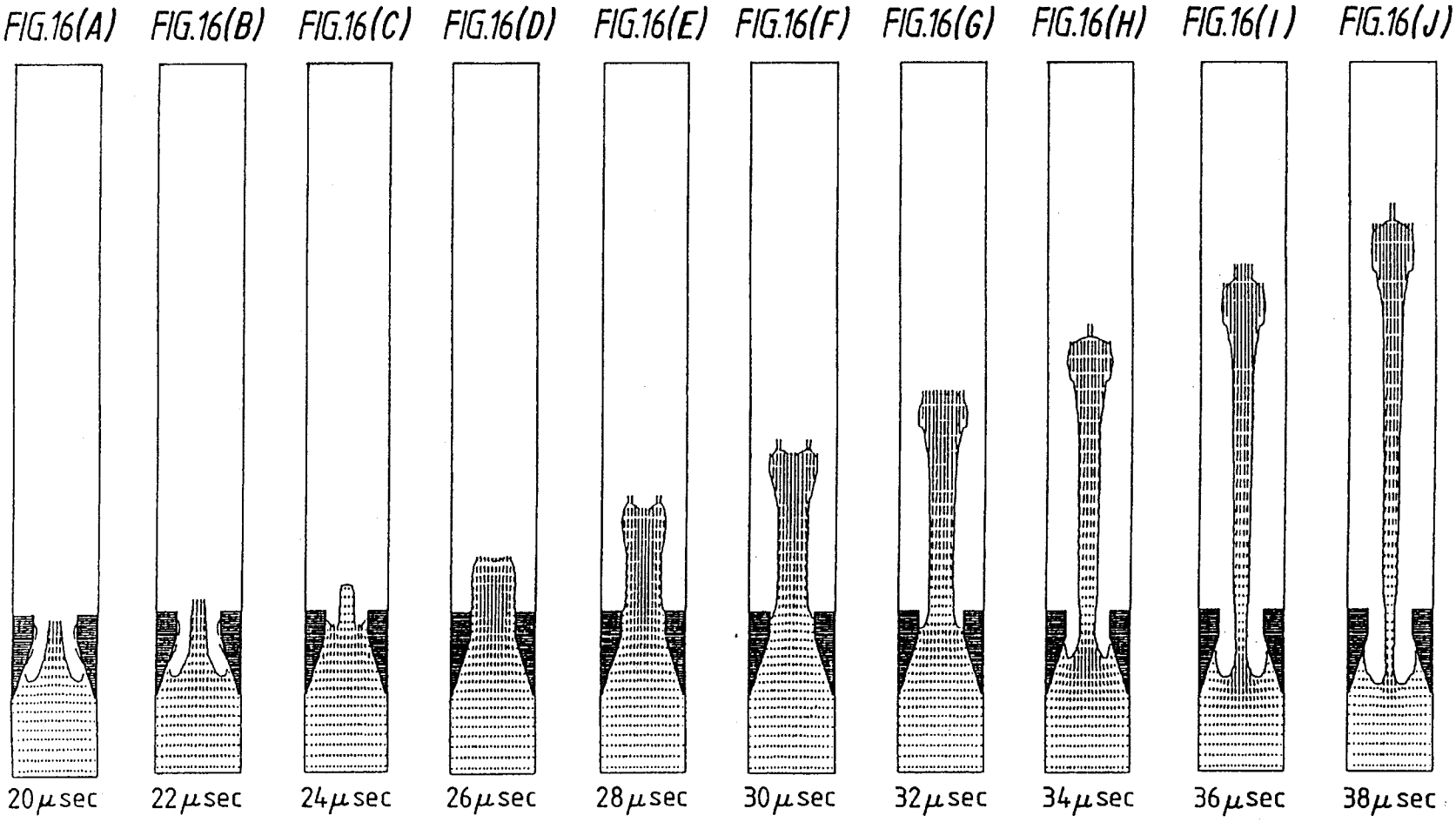
FIGS. 16(A) through 16(J) are diagrams chronologically showing the behavior of the meniscus when the piezoelectric vibrating element is contracted and left as contracted for 10 μsec and then expanded.
Figures 17A, 17B, 17C, 17D, 17E, 17F, 17G, 17H, 17I, 17J:
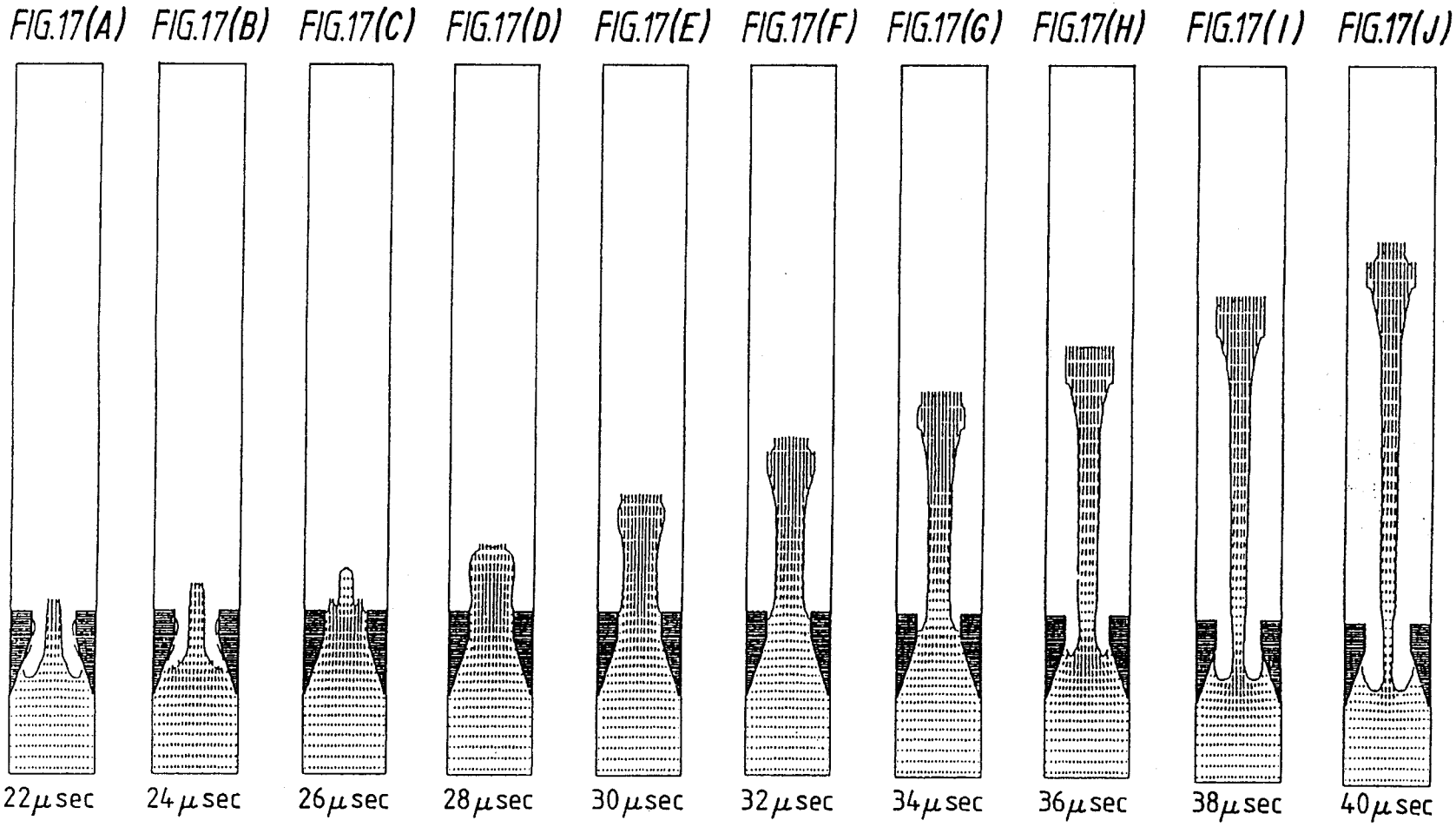
FIGS. 17(A) through 17(J) are diagrams chronologically showing the behavior of the meniscus when the piezoelectric vibrating element is contracted and left as contracted for 12 μsec and then expanded.
Figures 18A, 18B, 18C, 18D, 18E, 18F, 18G, 18H, 18I, 18J:
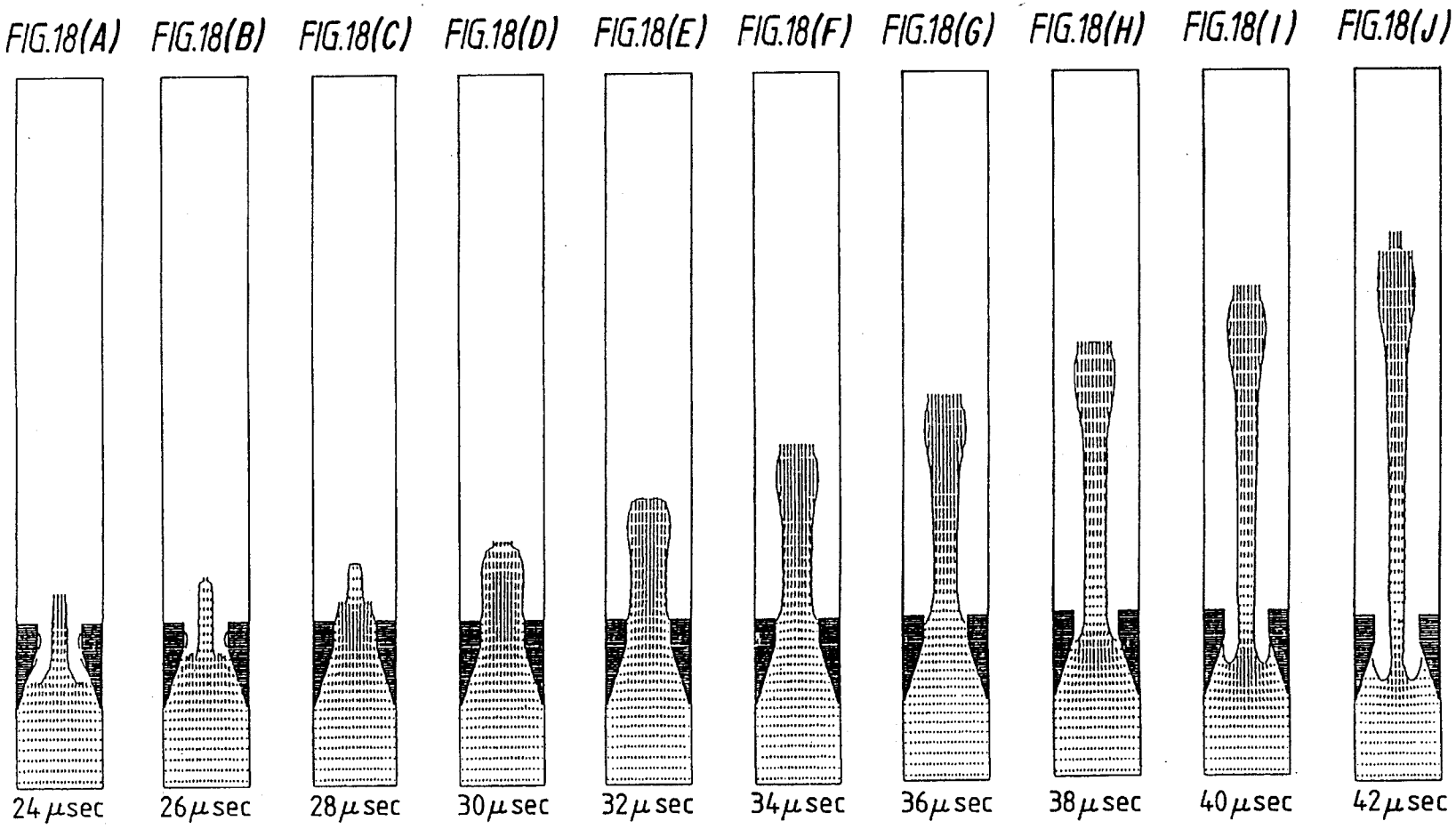
FIGS. 18(A) through 18(J) are diagrams chronologically showing the behavior of the meniscus when the piezoelectric vibrating element is contracted and left as contracted for 14 μsec and then expanded.

FIG. 14 shows flow of the ink when the pressure chamber is contracted upon elapse of 16 μsec from the application of the first drive voltage, i.e., with the holding time being 6 μsec. This is a flow of the ink when the piezoelectric vibrating element is expanded as the meniscus makes a small advance toward the nozzle opening after the retreat phase thereof and returns to a position about ⅓ of the farthest retreat position. Since a part of the front end of an ink droplet jetted out of the nozzle opening is constricted and transformed into a spherical form in the course of splashing, an ideally formed dot can be formed on a recording sheet.

FIGS. 15 through 18 respectively show flows of the ink when the time elapsing from the application of the second voltage is set to 18 μsec (the holding time is 8 μsec), 20 μsec (the holding time is 10 μsec), 22 μsec (the holding time is 12 μsec), and 24 μsec (the holding time is 14 μsec). It has been verified that the end of the ink droplet jetted out from the nozzle opening becomes spherical when the piezoelectric vibrating element is expanded at the respective times.

Figure 19:
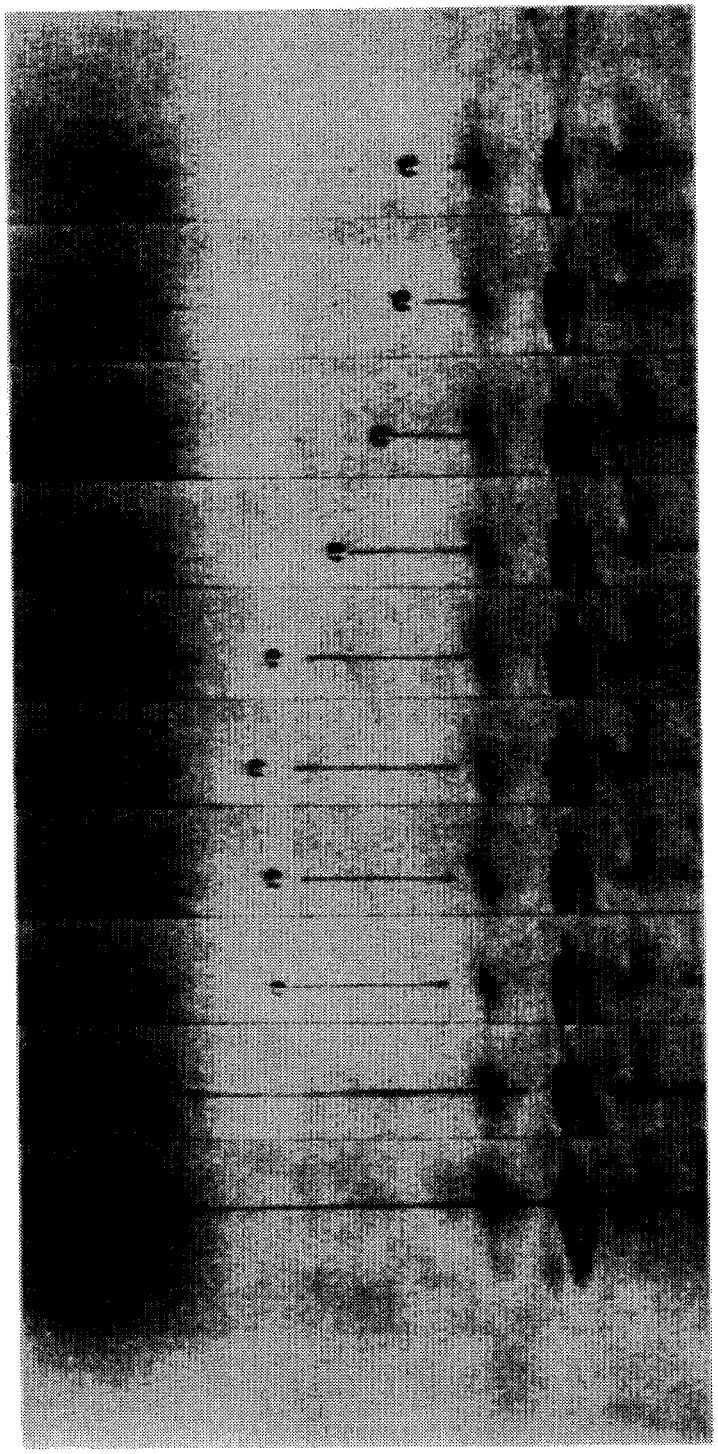
FIGS. 19(A) through 19(J) are diagrams showing the profile of an ink droplet at each of the above-mentioned holding times.

FIG. 19 shows various profiles of an ink droplet photographed by a high-speed camera in function of the holding time. The profiles of the ink droplet were photographed under the following steps using the recording head which is the model of the above-mentioned simulation. The photographs were taken by the steps of: jetting an ink droplet from the nozzle opening when the first drive voltage was applied for 10 μsec at a certain rate, i.e., at such a speed as to allow an ink droplet to splash in columnar form from the nozzle opening helped by the inertial stream if the meniscus was left as it was, so that the piezoelectric vibrating element was contracted at a certain rate; and leaving the piezoelectric vibrating element as contracted for an arbitrary time thereafter; and applying a drive voltage that changes at a certain rate for 10 μsec, so that the piezoelectric vibrating element was contracted. It is verified that the profiles with the holding time being 6 μsec or more (FIG. 19(III)) are such that the front end of an ink droplet jetted from the nozzle is constricted into a spherical form, whereas the profiles with the holding time being 4 μsec or less (FIGS. 19(II), 19(I)) are all columnar.

Figure 20:
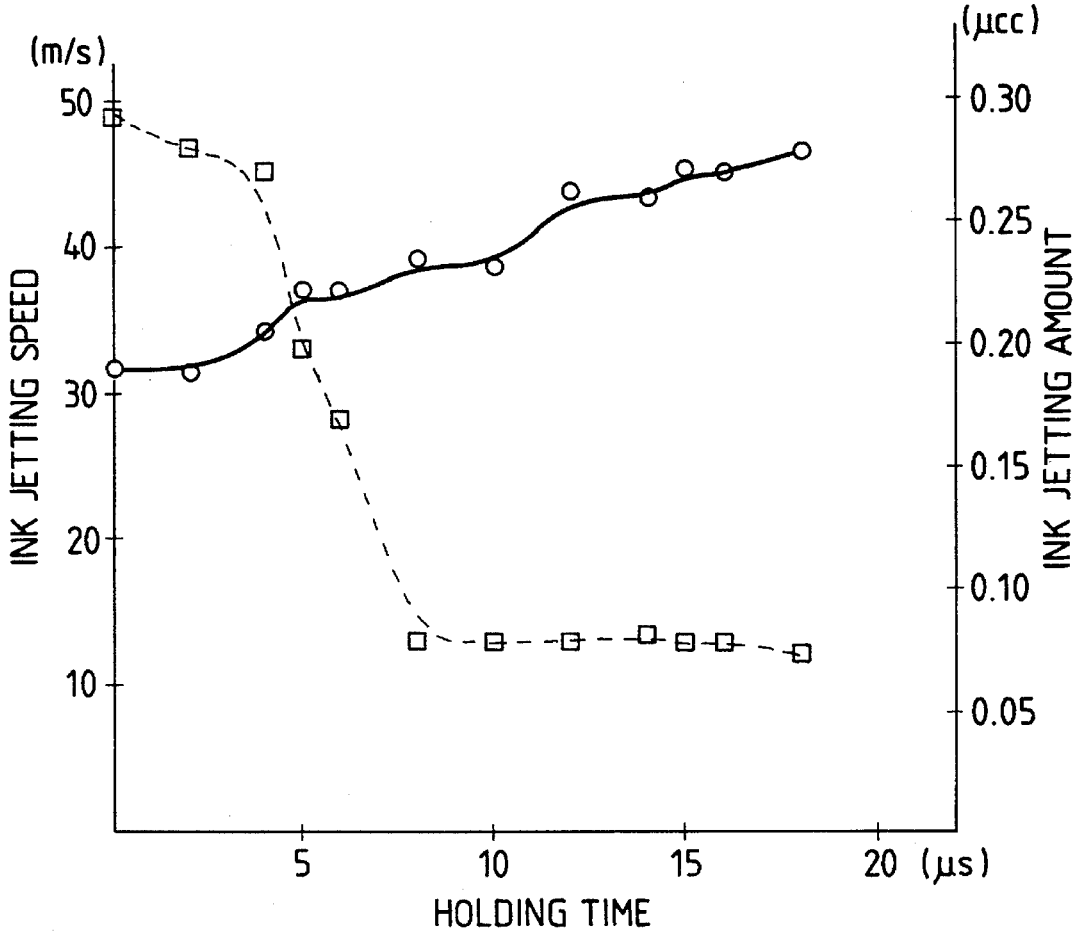
FIG. 20 is a diagram showing a relationship among the holding time, the ink jetting speed, and the ink jetting amount.

The amount of ink jetted from the nozzle opening every holding time and the ink jetting speed are as shown in FIG. 20. The amount of ink jetted (the solid line in FIG. 20) exhibits a slight increase with increasing holding time. The ink jetting speed drops drastically with increasing holding time up to 6 μsec, or a time at which the meniscus returns to a position about ⅓ of the farthest retreat position, while maintaining a constant value of about 12.5 m/sec with a holding time longer than 6 μsec. By the way, it is known that when the ink jetting speed is high, the ink droplet jetted from the nozzle becomes columnar, whereas that when the ink jetting speed is low, the ink droplet becomes spherical. It is also known that when the front end of a jetted ink droplet is spherical, the dot formed on a recording sheet is substantially circular. It has been verified from the above that an ideal dot, i.e., a circular dot can be printed with the above-mentioned model if the pressure chamber is contracted after the holding time of 6 μsec, i.e., after the meniscus has returned to a position ⅓ of the farthest retreat position.

The above fact has been further checked by observing various behaviors of the meniscus while changing parameters such as nozzle opening size, ink viscosity, and the gap between the nozzle plate and the vibrating plate. As a result, it is verified that the front end of an ink droplet splashing from the nozzle opening becomes spherical irrespective of parameters as long as the pressure chaffer is contracted at a time when the meniscus has returned to a position ⅓ of the farthest retreat position although the time in which the meniscus returns to such position ⅓ of the farthest retreat position varies.

The above means that the ink droplet can splash in spherical form irrespective of the position of the meniscus when the inertial stream produced as the vibrating plate is retreated expands the pressure chamber at such a high speed as to allow the ink droplet to be jetted from the nozzle opening and when the pressure chamber is contracted after the meniscus has returned to a position ⅓ of the farthest retreat position.

Figure 21:
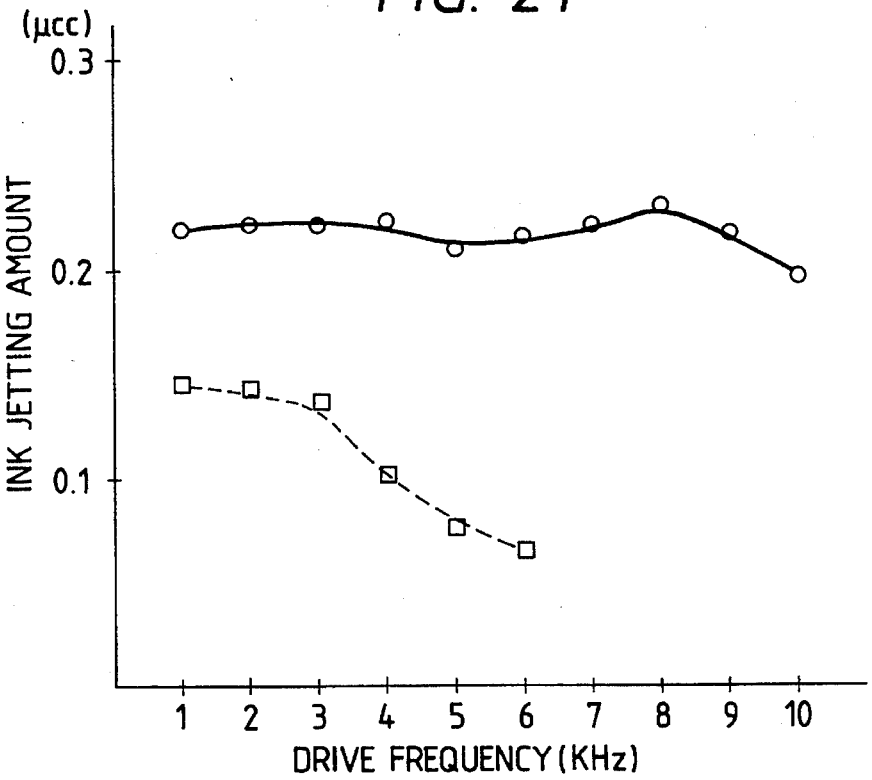
FIG. 21 is a diagram showing a relationship between the drive frequency and the ink jetting amount.
Figure 22:
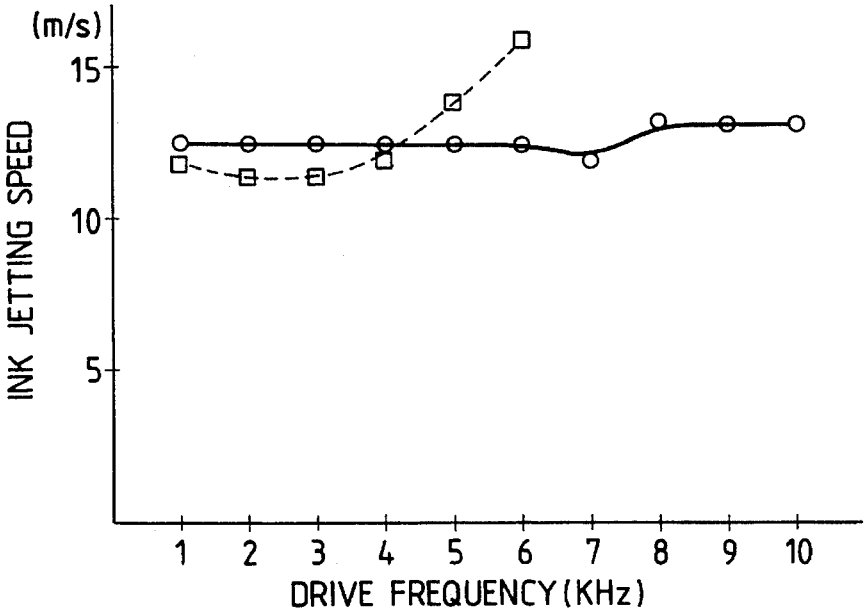
FIG. 22 is a diagram showing a relationship between the drive frequency and the ink jetting speed.

This means, in terms of the ink jet recording head drive frequency, that the ink jetting amount and speed become constant between the drive frequencies from 1 kHz to about 10 kHz as indicated by the solid lines in FIGS. 21, 22. This further means not only that high quality printing can be maintained at high speeds, but also that a certain print quality can be ensured for any dot forming mode, whether dots are formed contiguously, alternately, or every two dots.

In contrast thereto, the conventional drive method (the dotted lines in FIGS. 21, 22) exhibits a decrease in the ink jetting amount around a drive frequency of 3 kHz and a sudden rise of the ink jetting speed, which, as a result, causes the print quality thereof to be negatively affected by the drive frequency.

By the way, it is verified that when the vertical frequency mode is employed, the piezoelectric vibrating element is more difficult to be affected by components such as the vibrating plate and the ink compared with a piezoelectric vibrating element in the flexural vibration frequency mode and that the piezoelectric vibrating element vibrates only at the resonance frequency of the piezoelectric element alone.

On the other hand, the resonance frequency of the pressure chamber is determined by the acoustic inertances 45, 53, and the compliance 55. The resonance frequency fc of the pressure chamber is expressed as:

$$f=\frac{1}{2\pi}\sqrt{\frac{Mn+Ms}{Cc\times Mn\times Ms}}$$

where Mn is the acoustic inertance 45, Ms is the acoustic inertance 53, and Cc is the compliance.

It has been verified that when the pressure chamber is vibrated freely, the pressure chamber vibrates at the resonance frequency fc.

During the expansion and contraction of the pressure chamber, the residual vibration of the pressure chamber can be minimized after the expansion of the pressure chamber as well as the formation of the ink droplet by increasing the piezoelectric vibrating element displacing speed 0.9 times the characteristic vibrational period of the pressure chamber, i.e., by increasing the rising time and falling time of a voltage applied to contract and expand the piezoelectric vibrating element 0.9 times or more the characteristic vibrational period of the pressure chamber.

Also, to suppress the residual vibration of the piezoelectric vibrating element, the piezoelectric vibrating element displacing speed may be made equal to the characteristic vibrational period of the piezoelectric vibrating element.

Figure 23:
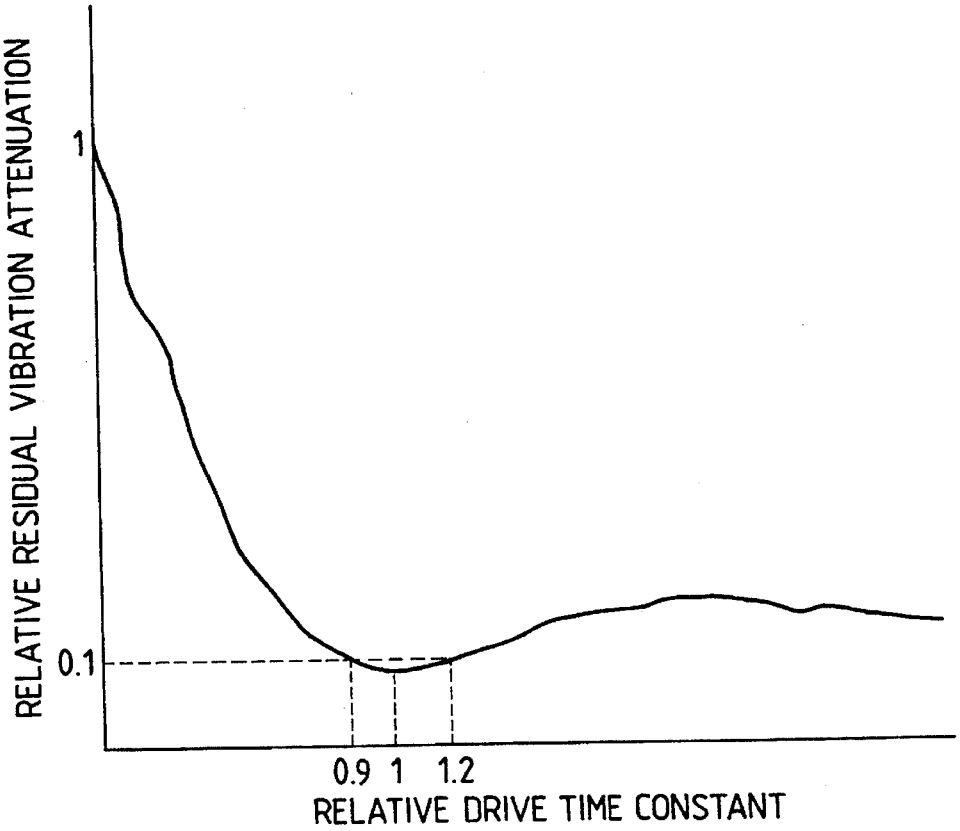
FIG. 23 is a diagram showing a relationship between the time constant and the damped vibration amplitude of a drive voltage when the piezoelectric vibrating element is expanded.

That is, as shown in FIG. 23, by setting the time constant of the discharge waveform at the time the voltage is being discharged to the range of from 90 to 120% of the characteristic vibrational period of the piezoelectric vibrating element itself, the residual vibration of the piezoelectric vibrating element itself after the displacement thereof as well as the residual vibration of the vibrating plate coupled thereto can be suppressed within about 10% of the amplitude at the time they are driven.

As described above, the residual vibration of the pressure chamber as well as the residual vibration of the piezoelectric vibrating element are can be suppressed by setting the piezoelectric vibrating element displacing speed, i.e., the rising and/or falling time of a voltage to arbitrary values, the voltage being applied to the piezoelectric vibrating element. However, it is apparent that timings matching other conditions such as the dimension, material, etc. of the piezoelectric vibrating element or the pressure chamber forming components must be selected.

That is, the following settings are preferable from the relationship between the characteristic vibrational period Ta of the piezoelectric vibrating element and the characteristic vibrational period Tc (=1/fc) of the pressure chamber.

1) If $Ta<Tc$, then $r1, r2 \geqq 0.9\times Tc$

2) If $Ta \geqq Tc$, then $0.9\times Ta \leqq \tau 1, \tau 2 \leqq 1.2\times Ta$ By setting the rising time and/or falling time of the voltage to be applied to the piezoelectric vibrating element in the above manner, dots can be formed immediately without providing a residual vibration attenuation wait time after the jetting of the ink which greatly affects particularly the frequency for repetitively driving the recording head, or the repetitive frequency, hence further improving the repetitive frequency.

While the case where the invention is applied to the ink jet recording head with the ink flow paths formed only on one side of each pressure chamber has been described in the above embodiment, it is apparent that the same effect can be obtained by applying the invention to an ink jet recording head having ink flow paths on both sides of each pressure chamber.

Also, the same effect can be obtained by applying the invention to a so-called face ejected ink jet recording head in which the vibrating plate is formed so as to confront the nozzle openings as well as to, e.g., a so-called edge ejected ink jet recording head in which an ink droplet is jetted parallelly to a vibrating element.

As described in the foregoing pages, the invention is characterized as involving: the first step of retreating the vibrating plate to a predetermined position from the nozzle opening at such a speed as to allow the meniscus at the nozzle opening to be jetted from the nozzle opening while applying a drive voltage to the piezoelectric vibrating element; the second step of holding the vibrating plate at the position; and the third step of advancing the vibrating plate toward the nozzle opening when the meniscus has returned to a position ⅓ or more of the farthest retreat position thereof. As a result, not only the ink stream that is produced adjacent to the nozzle opening when the piezoelectric vibrating element is contracted can be utilized positively, but also the pressure chamber can be contracted in a zone in which the ink jetting speed does not depend on the position of the meniscus, thereby allowing the size and splashing speed of an ink droplet to be maintained substantially constant in a wide range of drive frequencies. Thus, a high-seed recording apparatus can be achieved.

Further, since the rising and falling time for the charging or discharging at the time of jetting an ink droplet are set so as to match the vibrational periods of the pressure chamber and the piezoelectric vibrating element, the amplitude of the residual vibration of the vibration system including the piezoelectric vibrating elements after the jetting of an ink droplet can be reduced, thereby contributing to improving the repetitive drive frequency.

What is claimed is:

1. A method of driving an ink jet recording head, said ink jet recording head including a nozzle plate having one or more nozzle openings therein, a vibrating plate which opposes said nozzle plate to form a pressure chamber therebetween, said vibrating plate communicating with said nozzle openings in cooperation with said nozzle plate, one or more piezoelectric vibrating elements, each of said piezoelectric vibrating elements having one end which opposes at least one of said nozzle openings wherein said end is fixed to said vibrating plate, each of said piezoelectric vibrating elements vertically vibrates according to an applied voltage; said method comprising the steps of:

retreating said vibrating plate away from at least one of said nozzle openings to a predetermined position at such a speed as to allow a meniscus to retreat from said at least one of said nozzle openings by a retreat distance by applying a first drive voltage to at least one of said piezoelectric vibrating elements for contracting said at least one of said piezoelectric vibrating elements;

holding said vibrating plate at said predetermined position by applying a second drive voltage to said at least one of said piezoelectric vibrating elements for holding said at least one of said piezoelectric vibrating elements as contracted; and advancing said vibrating plate toward said at least one of said nozzle openings when said meniscus has returned by ⅓ or more of the retreat distance, by applying a third drive voltage to said at least one of said piezoelectric vibrating elements for expanding said at least one of said piezoelectric vibrating elements.

2. An apparatus for driving an ink jet recording head, comprising:

a nozzle plate having nozzle openings therein;

a vibrating plate which opposes said nozzle plate to form a pressure chamber therebetween, said vibrating plate communicating with said nozzle openings in cooperation with said nozzle plate;

piezoelectric vibrating elements, each of said piezoelectric vibrating elements having one end which opposes at least one of said nozzle openings wherein said end is fixed to said vibrating plate, said piezoelectric vibrating elements vertically vibrates according to an applied voltage; and means for driving said piezoelectric vibrating elements, said driving means generating a first voltage for contracting said piezoelectric vibrating elements at such a speed as to allow a meniscus to retreat from said nozzle openings by a retreat distance, and to thereafter be ejected from said nozzle openings;

a second voltage for holding said piezoelectric vibrating elements as contracted; and a third voltage for expanding said piezoelectric vibrating elements, said driving means maintaining said second voltage so that $T \geqq Tin$, where T is a second voltage holding time and Tin is a time from said first drive voltage having reached a steady-state to a time from said meniscus having returned ⅓ or more of the retreat distance.

3. An apparatus according to claim 2, wherein a time constant of at least one of said first drive voltage and said third drive voltage is set to a value 0.9 times a characteristic vibrational period of said pressure chamber.

4. An apparatus according to claim 2, wherein a time constant of said third drive voltage is set to a value 0.9 to 1.2 times a characteristic vibrational period of said pressure chamber.

5. A method of driving an ink jet recording head, said ink jet recording head including a nozzle plate having one or more nozzle openings therein, a vibrating plate which opposes said nozzle plate to form a pressure chamber therebetween, said vibrating plate communicating with said nozzle openings in cooperation with said nozzle plate, one or more piezoelectric vibrating elements, each of said piezoelectric vibrating elements having one end which opposes at least one of said nozzle openings wherein said end is fixed to said vibrating plate, each of said piezoelectric vibrating elements vertically vibrates according to an applied voltage; said method comprising the steps of:

retreating said vibrating plate away from at least one of said nozzle openings to a predetermined position at such a speed as to allow a meniscus to retreat from said at least one of said nozzle openings by a retreat distance by applying a first drive voltage to said at least one of said piezoelectric vibrating elements for contracting said at least one of said piezoelectric vibrating elements;

holding said vibrating plate at said predetermined position by applying a second drive voltage to said at least one of said piezoelectric vibrating elements for holding said at least one of said piezoelectric vibrating elements as contracted; and advancing said vibrating plate toward at least one of said nozzle openings when said meniscus has returned by ⅓ or more of the retreat distance irrespective of a position of the meniscus in relation to a position of the meniscus in a previous step of advancing said vibrating plate, by applying a third drive voltage to said at least one of said piezoelectric vibrating elements for expanding said at least one of said piezoelectric vibrating elements.

6. A method according to claim 5, wherein a time constant of at least one of said first drive voltage and said third drive voltage is set to a value 0.9 times a characteristic vibrational period of said pressure chamber.

7. An method to claim 5, wherein a time constant of said third drive voltage is set to a value 0.9 to 1.2 times a characteristic vibrational period of said pressure chamber.

8. An apparatus for driving an ink jet recording head, comprising:

a nozzle plate having nozzle openings therein;

a vibrating plate which opposes said nozzle plate to form a pressure chamber therebetween, said vibrating plate communicating with said nozzle openings in cooperation with said nozzle plate;

piezoelectric vibrating elements, each of said piezoelectric vibrating elements having one end which opposes at least one of said nozzle openings wherein said end is fixed to said vibrating plate, said piezoelectric vibrating elements vertically vibrates according to an applied voltage; and means for driving said piezoelectric vibrating elements, said driving means generating a first voltage for contracting said piezoelectric vibrating elements at such a speed as to allow a meniscus to retreat from said nozzle openings by a retreat distance, and to thereafter be ejected from said nozzle openings;

a second voltage for holding said piezoelectric vibrating elements as contracted; and a third voltage for expanding said piezoelectric vibrating elements, said driving means maintaining said second voltage so that $T \geqq Tin$, where T is a second voltage holding time and Tin is a time from said first drive voltage having reached a steady-state to a time from said meniscus having returned ⅓ or more of the retreat distance, irrespective of the position of the meniscus in relation to a position of a previously formed meniscus.

9. An apparatus according to claim 8, wherein a time constant of at least one of said first drive voltage and said third drive voltage is set to a value 0.9 times a characteristic vibrational period of said pressure chamber.

10. An apparatus according to claim 8, wherein a time constant of said third drive voltage is set to a value 0.9 to 1.2 times a characteristic vibrational period of said pressure chamber.

11. An method according to claim 1, wherein a time constant of at least one of said first drive voltage and said third drive voltage is set to a value 0.9 times a characteristic vibrational period of said pressure chamber.

12. An method to claim 1, wherein a time constant of said third drive voltage is set to a value 0.9 to 1.2 times a characteristic vibrational period of said pressure chamber.

* * * * *